United States Patent [19]

Damratoski

[11] Patent Number: 4,575,074

[45] Date of Patent: Mar. 11, 1986

[54] EXERCISE WEIGHT

[76] Inventor: Daniel J. Damratoski, 229 Roycroft Ave., Mt. Lebanon, Pa. 15234

[21] Appl. No.: 650,273

[22] Filed: Sep. 14, 1984

[51] Int. Cl.[4] ..... A63B 21/12

[52] U.S. Cl. ..... 272/119; 272/122

[58] Field of Search ..... 272/119, 116, 122, 123, 272/67, 68, 117, 143; D21/197; D9/374, 376, 378

[56] References Cited

U.S. PATENT DOCUMENTS

| | | | |
|---|---|---|---|
| 660,962 | 10/1900 | Kennedy | 272/122 |
| 1,990,970 | 2/1935 | Wood | 272/119 |
| 4,029,312 | 6/1977 | Wright | 272/122 X |
| 4,076,236 | 2/1978 | Baroi | 272/123 |
| 4,079,932 | 3/1978 | Schuetz | 272/75 |
| 4,103,887 | 8/1978 | Shoofler | 272/123 |
| 4,199,140 | 4/1980 | Ferretti | 272/123 |
| 4,311,306 | 1/1982 | Solloway | 272/122 X |
| 4,322,072 | 3/1982 | White | 272/119 |
| 4,351,526 | 9/1982 | Schwartz | 272/122 |

OTHER PUBLICATIONS

Hand Weight sold by Brookstone Co., 320 Smithfield Street, Pittsburgh, Pa. 15219, in Jul. of 1984.

*Primary Examiner*—Richard J. Apley
*Assistant Examiner*—Robert W. Bahr
*Attorney, Agent, or Firm*—Grigsby, Gaca & Davies

[57] ABSTRACT

An exercise weight that has a handgrip and a hollow body disposed about the handgrip so that the mass of the body and of any material with which it might be filled will be evenly disposed about the hand of the user. The hand grip has a rectangular cross-section so as to engage the articulations of the hand. A flat surface is provided above the handgrip so that the weight can be rested upon the thumb and first finger of the user's hand. The outer walls of the body are sloped and join the bottom at an obtuse angle. The distance between the handgrip and one of the inner walls of the body is such that the device may be used as either a hand weight or a foot weight.

5 Claims, 5 Drawing Figures

EXERCISE WEIGHT

BACKGROUND OF THE INVENTION

This invention relates to exercise weights and, in particular, to a weight of variable heaviness adapted for use on either the hands or feet during aerobic exercises.

During the past several years it has become apparent that the use of light weights during aerobic exercise will enhance body development and greatly increase the benefit to the cardiovascular system. The preferred amount of weight will vary with the physical condition of the individual and with the particular exercise being performed.

Dumbbells, which are basically comprised of a handgrip with a weight attached to each end, have been adapted for use as hand weights for aerobic exercise. See U.S. Pat. No. 4,351,526. However, the heaviness of such dumbbells can only be varied by changing the weights. Thus, a person whose physical condition is changing or who wishes to perform different exercises must have a variety of weights available to him.

Dumbbells have the further disadvantage of concentrating the weight at either end of the handgrip. When materials of relatively low density are used in such a configuration, the increased length of the device will increase the torque on the hand and wrist during exercise. The muscular fatigue induced by such torque will tend to limit the duration, and, hence, the aerobic benefit, of the exercise. This effect is particularly pronounced where, as is described in U.S. Pat. No. 4,076,236, additional weights consisting of hollow bodies containing materials of relatively low density are added to either end of the dumbbells.

In other variable weight exercise devices, such as that described in U.S. Pat. No. 4,079,932, the center of gravity is actually located distal to the hand. This configuration also tends to subject the hand and wrist to relatively high torques.

The devices described above are suitable only as hand weights. Other devices have been designed to variably weight the foot. E.g. U.S. Pat. Nos. 4,322,072; 1,990,970. Devices in the latter class are not, however, adapted for use as hand weights.

SUMMARY OF THE INVENTION

In the present invention, I provide a hollow body with an integral handgrip. The body is suitable for containing water, sand or other fluent material and is shaped so as to distribute the weight of the body and contained material closely and evenly around a hand grasping the handgrip. The handgrip is of generally rectangular cross-section so as to engage the articulations of the hand, thus helping to prevent turning of the handgrip within the hand and allowing the user to grasp the weight less tightly. A flat surface is provided above the handgrip so that the weight can be rested upon the thumb and first finger of the hand. The outer walls of the body are sloped so as to minimize impact if the user brings the weight too close to his own body. The width of the body and the distance from the handgrip to one of the inner walls of the body are such that the device may be used as a foot weight.

An object of my invention is to provide an exercise weight that can be varied in heaviness by filling it with various readily available, inexpensive, materials.

It is a further object of the invention to provide an exercise weight whose mass will be disposed closely about the hand of the user so as to minify the torque on the user's hand.

A further objection of the invention is to provide an exercise weight having a flat surface above the handgrip so that the weight can rest on the thumb and first finger of the user's hand, thereby reducing the strain on the muscles controlling the hand when the weight is held for long periods, as in jogging.

It is also an object of the invention to provide an exercise weight having a handgrip that is rectangular in cross-section such that the corners will engage the articulations of the hand, thus providing a better hold and permitting the weight to be held less tightly.

It is a further object of this invention to provide an exercise weight having smooth sloped sides to reduce the impact if the device is accidently brought too close to the user's body.

It is a further object of the invention to provide an exercise weight that is adapted for use as both a hand weight and a foot weight.

Other objects and purposes of the invention will be clear from the description of the preferred embodiment.

DESCRIPTION OF THE PREFERRED EMBODIMENT

Figure 1:
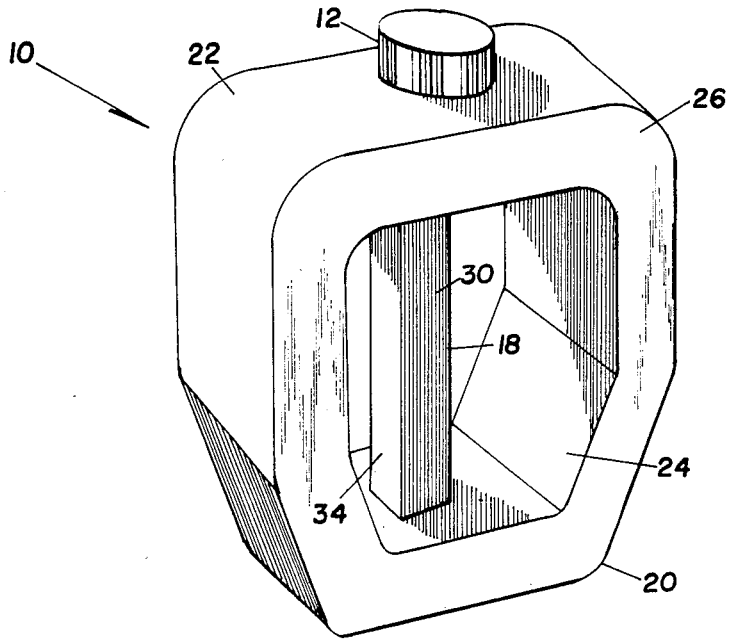
FIG. 1 is an isometric view of the preferred embodiment of the exercise weight of this invention.
Figure 2:
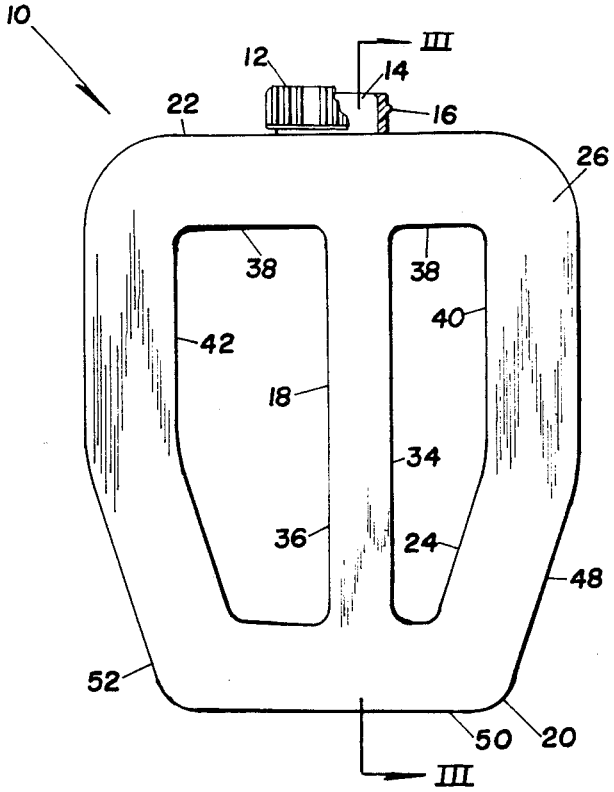
FIG. 2 is an elevation view of the device shown in FIG. 1.
Figure 3:
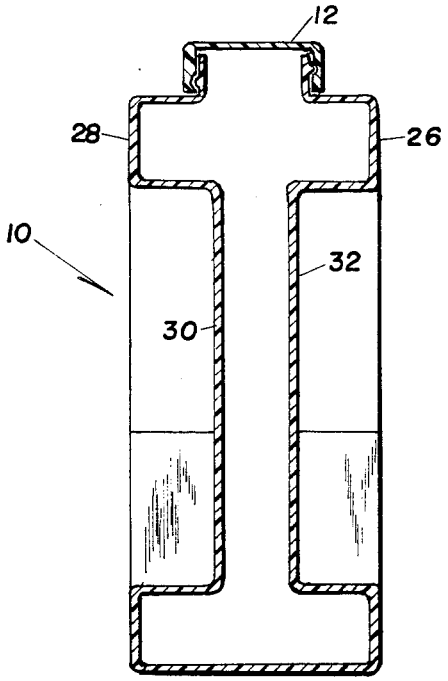
FIG. 3 is a sectional view on the line III—III of FIG. 2.

Referring to the drawings, FIG. 1 shows an exercise weight comprised of a molded hollow plastic body 10 and cap 12. The body 10 has single opening 14 surrounded by a threaded neck 16 that may be closed by the cap 12. The body 10 is further comprised of a handgrip 18 and peripheral body 20. I will designate the major surfaces of the peripheral body 20 as the outer wall 22, the inner wall 24, and edge walls 26 and 28. The transitions from one wall to another are rounded so as not to present sharp corners that could cause injury.

For the purposes of description, I will designate the portion of the outer wall 22 having the opening 14 as the "top" of the weight. It should be understood, however, that this part of the weight will not always be the highest part when it is in use.

The handgrip 18 is rectangular in cross-section so that the corners will engage the articulations of the hand. I have found it preferable to make the short sides 30 and 32 of the handgrip 18 approximately $\frac{3}{4}$ inch (1.91 cm.) wide and the long sides 34 and 36 approximately $1\frac{1}{8}$ inch (2.86 cm.) wide. I have also found it preferrable to make the handgrip 18 approximately 5 1/9 inch (13.34 cm.) long. I have found that these dimensions will comfortably accomodate the hands of most users.

Figure 4:
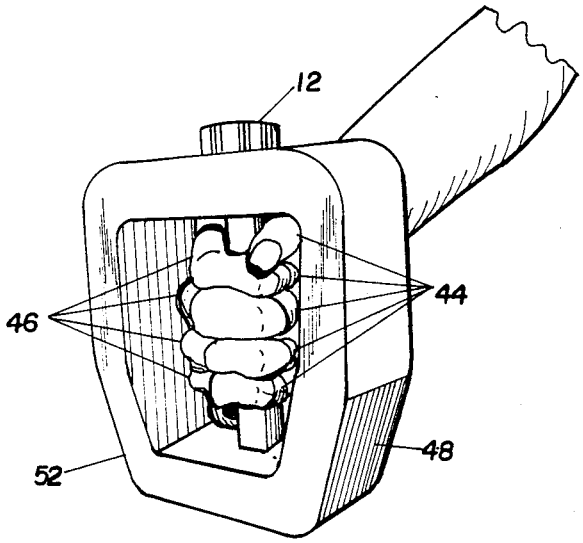
FIG. 4 is an isometric view of the device as used as a hand weight.

The handgrip 18 joins the upper segment 38 of the inner wall 24 at substantially a right angle. Segment 38 thus provides a surface that can rest on the thumb and first finger of a hand grasping the handgrip 18 as illustrated in FIG. 4. Resting the weight on the hand in this manner minimizes fatigue of the muscles that flex the hand when the weight is held for extended periods, as during jogging.

The handgrip 18 is centered between the edge walls 26 and 28, but is closer to side segment 40 of the inner wall 24 than it is to side segment 42. The handgrip 18 is located so that the least distance between the side segment segment 40 and any of the user's distal phalanges 44 is substantially equal to the least distances between side segment 42 and any of the user's metacarpophalangeal joints 46. This disposes the mass evenly about the hand and, when the weight is proportioned so as to minimize the clearance between the peripheral body and the user's hand, minimizes the torque on the user's hand and wrist.

Outer side segment 48 joins bottom segment 50 at an obtuse angle so as to minimize the impact if the weight is brought too close to the body during exercise. Side segment 52 joins bottom segment 48 at the same angle so that the peripheral body 20 will be symmetric and substantially equal masses will be disposed on the palmar and dorsal sides of the user's hand, thus providing a balanced weight when the hand grip 18 is held vertical.

I have found that a weight of the type described herein will be suitable for use by the average person if the edge walls 26 and 28 are spaced 3 inches (7.62 cm.) apart, the two vertical portions of the outer side segments 48 and 52 are spaced 6¼ inches (15.88 cm.) apart, the distance from each flat segment of outer wall 22 to the corresponding segment of the inner wall 24 is 1⅛ inch (2.86 cm.), the vertical distance from the top segment of outer wall 22 to the points at which the side segments 48 and 52 turn away from the vertical toward bottom segment 50 is 4 inches (10.16 cm.), the distance from the vertical portion of the inner side segment 40 to handgrip 18 is 1¼ inch (3.18 cm.), and the distance from the vertical portion of side segment 42 to handgrip 18 is 1¾ inch (4.45 cm.). A device having these dimensions will have the following approximate weights when filled with the indicated materials.

| Filler | Weight |
|---|---|
| Water | 2.4 lbs. |
| Dry sand | 3.3 lbs. |
| Wet sand | 4.3 lbs. |
| Lead shot | 13.0 lbs. |

Other materials may, of course, be used to obtain other weights. While a weight may be used when only partially filled, I consider this to be less desirable because the center of gravity can then shift due to the movement of filler within the weight.

Figure 5:
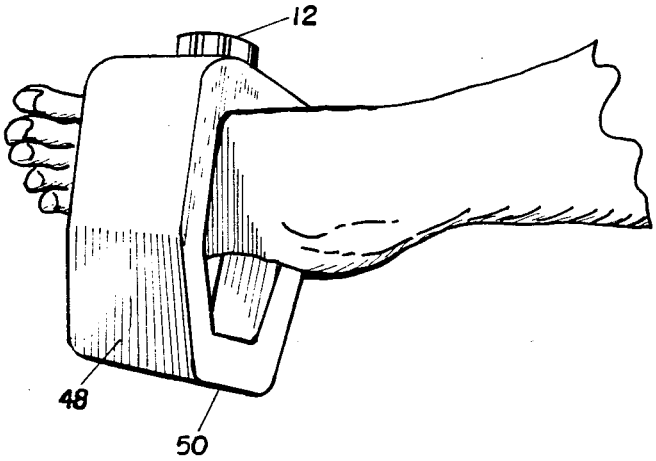
FIG. 5 is an isometric view of the device as used as a foot weight.

While the configuration of the device described herein is intended to optimize its utility as a hand weight, it can also be utilized as a foot weight, as is illustrated in FIG. 5. In the embodiment described above, the average person's foot may be inserted between the handgrip 18 and inner side segment 42 of peripheral body 20 until side segment 42 rests upon the user's medial cuneiform.

Many changes and modifications in the above described embodiment of the invention can, of course, be carried out without departing from the scope thereof.

I claim:

1. An exercise weight comprising;

a. a handgrip;

b. a symmetric hollow peripheral body of substantially uniform internal cross-section having an opening therein whereby the peripheral body may be filled with fluent material and further having a first inner wall segment and a second inner wall segment spaced apart therefrom, the peripheral body being joined to the handgrip in such relationship that the hardgrip is located between the first inner wall segment and the second inner wall segment with the distance from the handgrip to the first inner wall segment being sufficiently greater than the distance from the handgrip to the second inner wall segment that the mass of the peripheral body and of any material with which it may be filled will be substantially uniformly distributed about the hand of a user when grasping the handgrip; and c. means for closing the opening in the peripheral body.

2. An exercise weight comprising;

a. a handgrip;

b. a symmetric hollow peripheral body of substantially uniform internal cross-section having an opening therein whereby the peripheral body may be filled with fluent material and further having a first inner wall segment and a second inner wall segment spaced apart therefrom, the peripheral body being joined to the handgrip in such relationship that the handgrip is located between the first inner wall segment and the second inner wall segment with the distance from the handgrip to the first inner wall segment being sufficiently greater than the distance from the handgrip to the second inner wall segment that the least distance between the first inner wall segment and any of the metacarpophalangeal joints of the hand of a user when grasping the handgrip will be substantially equal to the least distance between the second inner wall segment and any of the distal phalanges of the same hand when grasping the handgrip; and c. means for closing the opening in the peripheral body.

3. An exercise weight as in claims 1 or 2 wherein the handgrip is in the shape of a rod the cross-section of which is substantially a rectangle having a first pair of parallel sides and a second pair of parallel sides which are shorter than the first pair of parallel sides.

4. An exercise weight as in claims 1 or 2 wherein at least one end of the handgrip joins the peripheral body at substantially a right angle and the peripheral body provides a flat surface adjacent to the handgrip, the flat surface being sufficiently large that it may be rested upon the thumb and first finger of the hand of a user when grasping the weight.

5. An exercise weight as in claims 1 or 2 wherein the outer side surfaces of the peripheral body are substantially flat and join the outer bottom surface at an obtuse angle.

* * * * *